US005160132A

United States Patent [19]

Hanada

[11] Patent Number: 5,160,132

[45] Date of Patent: Nov. 3, 1992

[54] SHEET CONVEYING/SORTING SYSTEM

[75] Inventor: Yoshikazu Hanada, Fujinomiya, Japan

[73] Assignee: Fuji Photo Film Co., Ltd., Kanagawa, Japan

[21] Appl. No.: 774,867

[22] Filed: Oct. 11, 1991

[30] Foreign Application Priority Data

Oct. 15, 1990 [JP] Japan ..... 2-275717
Oct. 2, 1991 [JP] Japan ..... 3-254949

[51] Int. Cl.[5] ..... B65H 7/02

[52] U.S. Cl. ..... 271/265; 271/270; 271/183; 271/202; 271/197

[58] Field of Search ..... 271/270, 266, 149, 216, 271/182, 183, 202, 209, 198, 265, 196, 197, 276

[56] References Cited

U.S. PATENT DOCUMENTS 3,477,711 11/1969 Lyman ..... 271/74
4,313,600 2/1982 Mosburger ..... 271/270 X
5,054,763 10/1991 Achelpohl et al. ..... 271/182

FOREIGN PATENT DOCUMENTS 649326 8/1937 Fed. Rep. of Germany .
3040021 5/1982 Fed. Rep. of Germany .
3138481 6/1983 Fed. Rep. of Germany .
3831742 6/1989 Fed. Rep. of Germany .
1516303 7/1978 United Kingdom .
2074990 11/1981 United Kingdom .

*Primary Examiner*—H. Grant Skaggs
*Assistant Examiner*—Carol Lynn Druzbick
*Attorney, Agent, or Firm*—Sughrue, Mion, Zinn, Macpeak & Seas

[57] ABSTRACT

A sheet conveying/sorting system which sorts sheets being successively conveyed by a target number of sheets, that is, by a package units. The sheet conveying-/sorting system includes a downstream conveyor, an upstream conveyor, sucking conveyor and controller. In the sheet conveying/sorting system, in accordance with a signal output from the control, the successively conveyed sheets are separated from each other and, after separation, the respective parts of the system are returned to their original positions. By repeating these steps sequentially and sucessively, the sheets can be sorted by the package units.

5 Claims, 12 Drawing Sheets

SHEET CONVEYING/SORTING SYSTEM

BACKGROUND OF THE INVENTION

1. Field of the Invention

The present invention relates to a sheet conveying and sorting system and, in particular, to such sheet conveying and sorting system which sorts sheets such as paper, film, metal foil or the like and collects the sheets by a given number of sheets (which can also be referred to as a package unit of sheets).

2. Description of the Related Art

Generally, after a long web of paper, film, metal foil or the like is cut into sheets, the sheets are collected by a given number of sheets (which will hereinafter be referred to as a package unit of sheets as well) and are then shipped. And, a sheet conveying/sorting system which sorts the sheets by the package unit includes mainly the following types:

A first type is a sheet conveying/sorting system which is shown in FIG. 12. As shown in FIG. 12, a long web 12 sent out from a roll 10 is cut by a cutter 14 into predetermined length of sheets 16. The thus cut sheets 16 are then sorted by a sheet sorting gate 18 of the sheet included in the sheet conveying/sorting system into two passages, that is, an upper conveying passage 20 and a lower conveying passage 22. By means of this, the sheets 16 can be collected by the package units into an upper collecting part 24 and a lower collecting part 26 alternately.

In a second type of sheet conveying/sorting system, the sheets are gated out at the reduced sheet cutting speed to a reject gate provided downstream of a cutting part to thereby obtain a switch time for sorting the sheets, and the sorted sheets are then collected by the package units.

A third type of sheet conveying/sorting system includes in the collecting part thereof a fork for sorting the sheets and the third type system is able to sort the sheets by the package units by advancing and retreating the fork. (Refer to Japanese Patent Application Laid-Open (Tokkai) No. 55-40137, No. 57- 27860, and No. 2-70660).

In a fourth type of sheet conveying/sorting system, there is disposed a stopper in the middle of a conveying passage, the sheets are held by and between the stopper and the conveying passage, the sheets are stopped so the distance between the sheets being conveyed on and the sheets being stopped is increased, and then the sheets are sorted by the package units (see Japanese Patent Application Laid-Open (Tokkai) No. 1-294164).

A fifth type of sheet conveying/sorting system includes an inside conveyor and an outside conveyor which is disposed along the outer periphery of the inside conveyor. And, a holding conveyor is disposed above the outside conveyor. While sheets being moved are being held by and between the outside and holding conveyors, the speed of the inside conveyor is increased to widen the distance between the sheets being held and the sheets being carried on the inside conveyor, so that the sheets can be sorted by the package units (see Japanese Patent Application Laid-Open (Tokkai) No. 2-127355).

However, in the first type of sheet conveying and sorting system, since the sheets 16 are sorted into the upper conveying passage 20 and lower conveying passage 22, at least two conveying passages for sorting are necessary. This results in the increased manufacturing cost and also requires a large installation space.

Also, in the second type of sheet conveying/sorting system, the gating-out of the sheets leads to the lowered rate of the quantity of sheets that is theoretically expected in a production process and at the same time, because the sheets are sorted by reducing the sheet cutting speed, a production efficiency is lowered as well.

Further, referring now to the third and fourth types of sheet conveying/sorting systems, because the third type sorts the sheets by use of the fork, and because the fourth type sorts the sheets while the sheets are being held by and between the stopper and conveying passage, there is a possibility that the sheet conveying attitude or the positional relationship between the sheets can be disturbed or that, when the sheet has a soft surface, the sheet surface can be abraded. In addition, these types of systems are disadvantageous in that the sheets conveying operation thereof is not stable.

Moreover, in the fifth type of sheet conveying/sorting system, since the leading end of the sheet held by and between the inside and holding conveyors may be rubbed against the inside conveyor, the soft sheet surface can be abraded. Also, the fifth type system finds it hard to adapt itself to a small package.

SUMMARY OF THE INVENTION

The present invention aims at eliminating the drawbacks found in the above-mentioned conventional sheet conveying/sorting systems.

Accordingly, it is an object of the invention to provide a sheet conveying/sorting system which can be manufactured at low costs, does not require a large installation space, does not lower the theoretical expectation rate and production efficiency of sheets, and prevents the sheets against abrasion.

In order to achieve the above object, according to the invention, there is provided a sheet conveying/sorting system which sorts a plurality of sheets being successively conveyed into a plurality of groups or package units each consisting of a given number of sheets, the sheet conveying/sorting system comprising: downstream conveying means capable of changing the conveying speed of the sheets; upstream conveying means disposed upstream of the downstream conveying means and including a conveying passage, the conveying passage of the upstream conveying means being expandable and contractible along the conveying passage of the downstream conveying means; sucking/conveying means disposed above the conveying passages of the upstream and downstream conveying means for attracting the sheets and conveying the sheets along the conveying passages; and control means for counting the number of the sheets being conveyed and outputting a separation signal when the number of the sheets being conveyed reaches a given number to thereby allow the sucking/conveying means to execute its attracting operation and to increase the conveying speed of the downstream conveying means over the conveying speed of the upstream conveying means to thereby separate the sheets from the following sheets, at the same time for expanding the conveying passage of the upstream conveying means and conveying the following sheets together with the sucking/conveying means, and, after a return detector disposed downstream detects the upstream conveying means, for outputting a return signal to contract the expanded conveying passage of the upstream conveying means to thereby return the upstream conveying means conveying passage to its original length and to stop the attracting operation of the sucking/conveying means and return the sucking/conveying means to its original position, at the same time to return the conveying speed of the downstream conveying means to the speed equal to the conveying speed of the upstream conveying means.

According to the invention, when the number of cut sheets to be conveyed reaches a target number or a given number, then a separation signal is output from the control means. The separation signal expands the conveying passage of the upstream conveying means as well as allows the sucking/conveying means to perform its attracting operation to thereby attract the sheets in the conveying passage of the upstream conveying means. Also, the separation signal allows the sucking-/conveying means to move following the expansion of the upstream conveying means. At the same time, the separation signal makes the conveying speed of the downstream conveying means faster than the conveying speed of the upstream conveying means. The difference between the conveying speeds of the downstream and upstream conveying means causes the sheets in the conveying passage of the downstream conveying means to be separated from the sheets attracted by the sucking-/conveying means.

After the sheets are separated from each other, a return signal is output from the control means. The return signal contracts the expanded conveying passage of the upstream conveying means to return its original length before it is expanded as well as stops the attracting operation of the sucking/conveying means. At the same time, the return signal returns the conveying speed of the downstream conveying means to the speed equal to the conveying speed of the upstream conveying means. In this manner, the present sheet conveying-/sorting system is returned to its original state and the sheets are conveyed successively from the upstream conveying means to the downstream conveying means.

After then, the above-mentioned steps are sequentially repeated so that the sheets can be sorted by the target number of sheets, that is, by the package units of sheets.

BRIEF DESCRIPTION OF THE DRAWINGS

The exact nature of this invention, as well as other objects, features and advantages thereof, will be readily apparent from consideration of the following specification relating to the accompanying drawings, in which like reference characters designate the same or similar parts throughout the figures thereof and wherein:

FIG. 8 (B) is a front view of FIG. 8 (A);

FIG. 9 (B) is a front view of FIG. 9 (A);

DESCRIPTION OF THE PREFERRED EMBODIMENT

Detailed description will hereunder be given of the preferred embodiment of a sheet conveying/sorting system according to the present invention with reference to the accompanying drawings.

Figure 1:
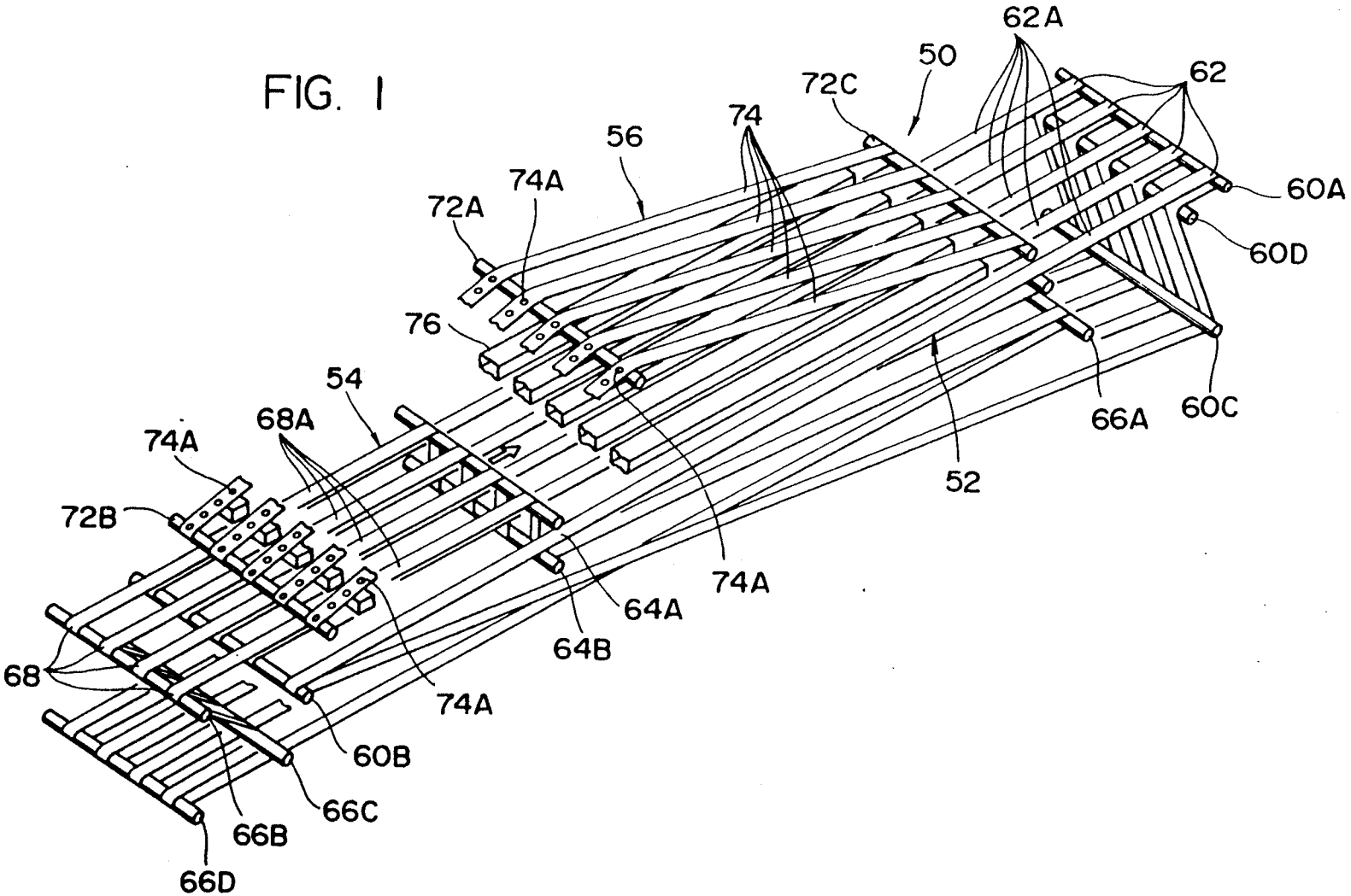
FIG. 1 is a perspective view of a sheet conveying-/sorting system according to the invention.
Figure 2:
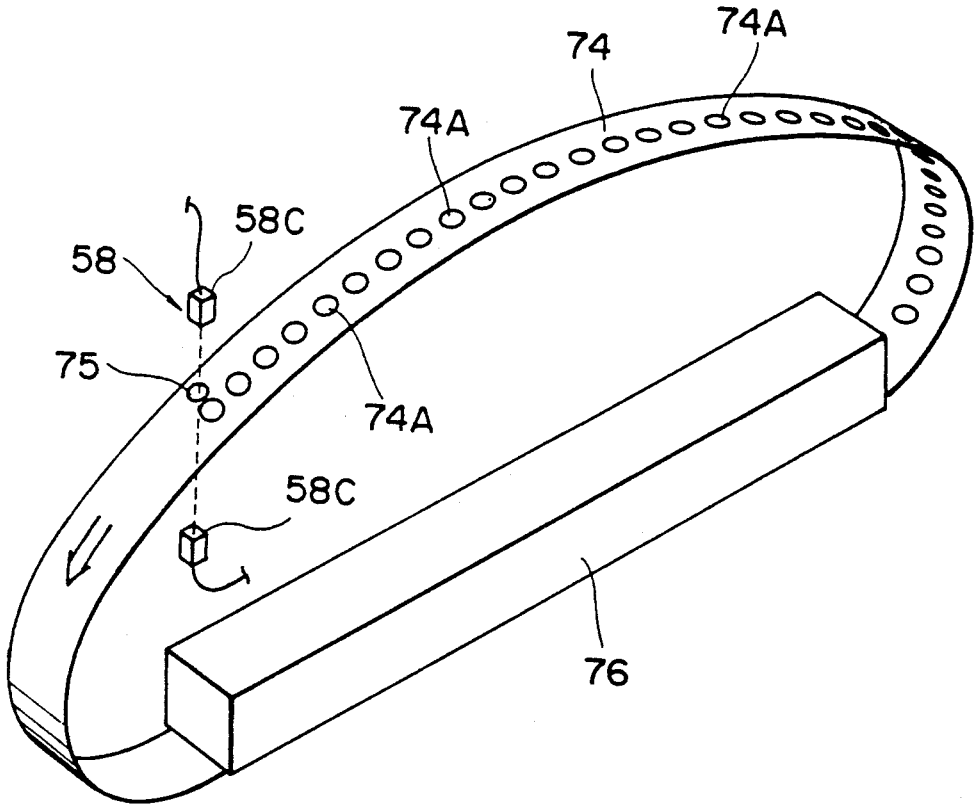
FIG. 2 is an enlarged view of the main portions of attracting/conveying means used in the present sheet conveying/sorting system.

Referring first to FIG. 1, there is shown a perspective view of a sheet conveying/sorting system 50 constructed in accordance with the present invention. The sheet conveying/sorting system 50 comprises downstream conveying means (separating conveyor means) 52, upstream conveying means (movable conveyor means) 54, sucking/conveying means (suction conveyor means) 56, control means 58 (shown in FIGS. 2, 3 and 5) and the like.

The downstream conveying means 52 includes fixed pulleys 60A, 60B, 60C and 60D around which a plurality of endless belts 62 are stretched at regular intervals and according to the width of the sheet conveying/sorting system 50. These belts 62 can be moved clockwise in FIG. 1 by first drive means (not shown) through the pulleys and are connected so that the moving speeds of the belts 62 can be changed. And, the portion of the belt 62 that is stretched horizontally by the fixed pulleys 60A, 60B forms a conveying passage 62A.

The upstream conveying means 54 includes a movable pulleys 64A, 64B and fixed pulleys 66A, 66B, 66C and 66D, around which pulleys a plurality of belts 68 are stretched. These belts 68 are respectively arranged at the same intervals as in the respective belts 62 of the downstream conveying means 52. The belts 68 are connected through the belts to second drive means (not shown) in such a manner that they can be rotated clockwise in FIG. 1.

Also, the movable pulleys 64A, 64B are constructed in such a manner that they can be moved along the conveying passage 62A of the downstream conveying means 52. And, the portions of the belts 68 that are stretched horizontally around by the movable pulley 64A and fixed pulley 66B form the conveying passage 68A of the upstream conveying means 54. The conveying passage 68A is disposed in parallel to the conveying passage 62A of the downstream conveying means 52.

The sucking/conveying means 56 includes fixed pulleys 72A, 72B and 72C which are disposed above the downstream conveying means 52 and upstream conveying means 54. A plurality of endless belts 74 are stretched substantially in a triangle around the fixed pulleys 72A, 72B and 72C. The belts 74 are respectively connected to third drive means (not shown) in such a manner that they can be moved counter-clockwise in FIG. 1. At the portions of the respective belts 74 that extend about a half of the peripheral length thereof, there are formed holes 74A, 74A, . . . at regular intervals, respectively.

In the bottom side part of the substantial triangle formed by the belts 74, there is provided a suction box 76 in contact with the upper surfaces of the respective belts 74. The suction box 76 is constructed in such a manner that it is in communication with a suction pump (not shown). Also, the suction box 76 has a suction port (not shown) the surface thereof which is in contact with the belts 74. For this reason, when the belts 74 are put into operation and the holes 74A, 74A, are brought into contact with the suction box 76, then the holes 74A, 74A, . . . of the belts 74 provide suction ports, respectively.

Figure 3A:
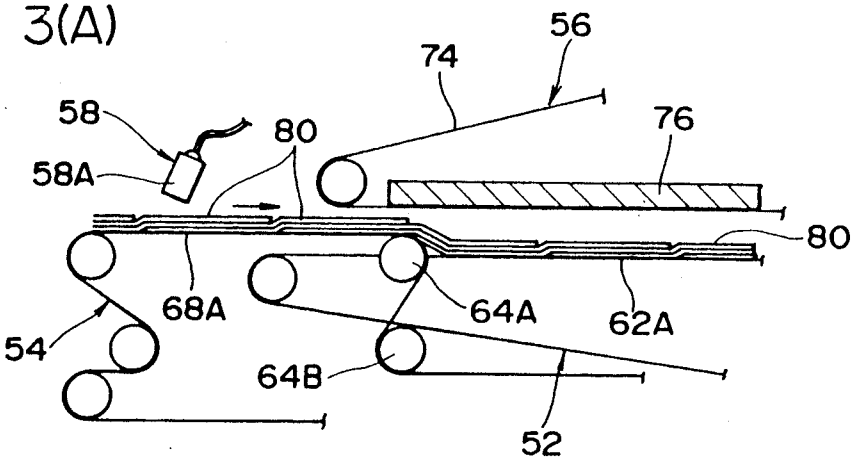
FIG. 3(A) is an enlarged view of the main portions of the present sheet conveying/sorting system, illustrating a state in which the present system is not performing an operation of separating the sheets.

The control means 58 includes a detector 58A which, as shown in FIG. 3(A), is disposed above the upstream conveying means 54 and on the upstream side of the fixed pulley 72B of the sucking/conveying means 56. The detector 58A counts the number of sheets 80, 80, . . . conveyed and, when the number of sheets 80 conveyed reaches a target number, that is, a package unit number, outputs a separation signal. The separation signal output from the detector 58A is input through the control means 58 into the downstream conveying means 52, upstream conveying means 54 and sucking/conveying means 56.

The separation signal controls the second drive means of the upstream conveying means 54 to move the movable pulleys 64A, 64B in a conveying direction at the same speed as the speed of the subject conveying means. At the same time, the separation signal controls the third drive means of the sucking/conveying means 56 to suck in air through the holes 74A, 74A, . . . of the belts 74 in contact with the suction box 76 and also controls the first conveying means of the downstream conveying means 52 to make the conveying speed thereof faster than the conveying speed of the upstream conveying means 54.

Also, the control means 58 outputs a return signal after a return detector 58B (see FIG. 5) disposed downstream detects the pulleys 64A, 64B. The return signal causes the movable pulleys 64A, 64B of the upstream conveying means 54 to move upstream and, after the movable pulleys 64A, 64B are detected by the given position detector 58D (see FIG. 5), the return signal causes the pulleys 64A, 64B to stop their movements, so that the movable pulleys 64A, 64B can be returned to their respective original positions. At the same time the returns signal returns the increased conveying speed of the downstream conveying means 52 to the conveying speed of the upstream conveying means 54. At the same time, the holes 74A, 74A, . . . of the belts 74 of the sucking/conveying means 56 are moved from the lower portion of the suction box 76 to the upper portion thereof, which causes the sucking/conveying means 56 to stop its sucking operation. In this case, a given position stop detector 58C (see FIG. 2) included in the control means 58 detects position determining holes 75 formed in the belts 74 of the sucking/conveying means 56 and outputs a stop signal. The third drive means is caused to stop in accordance with the stop signal. For this reason, the belts 74 of the sucking/conveying means 56 locate the holes 74A, 74A, . . . at the wait positions of the next step before they are stopped.

Figure 3B:
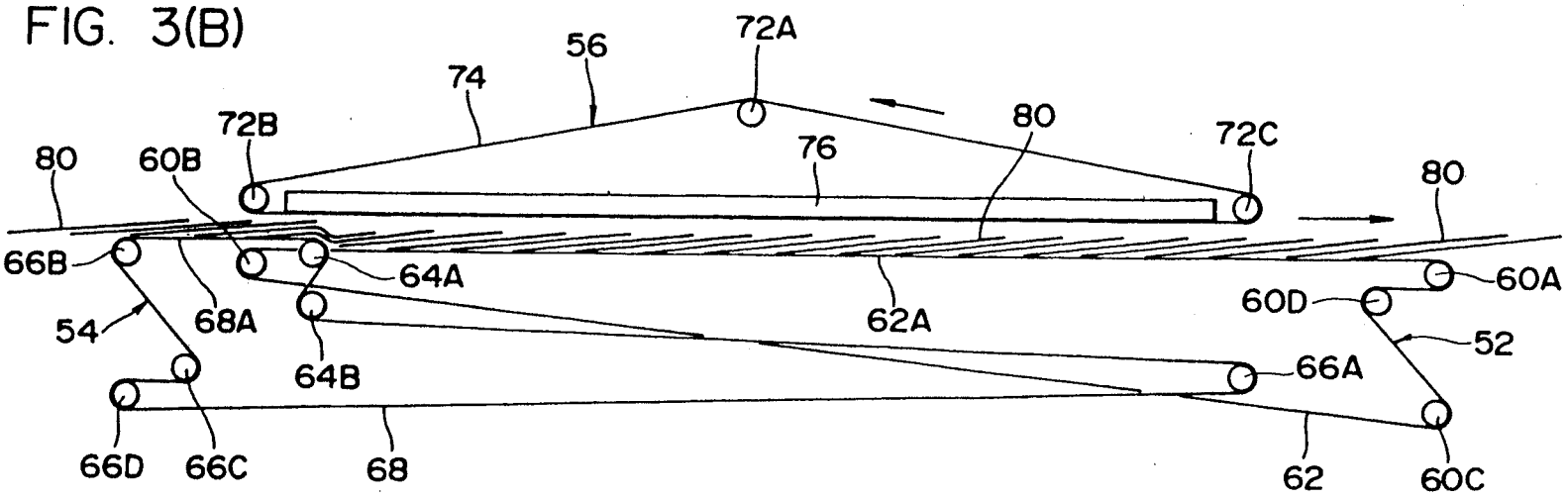
FIG. 3(B) is a front view of the main portions of the present sheet conveying/sorting system in the state shown in FIG. 3(A)
Figure 5:
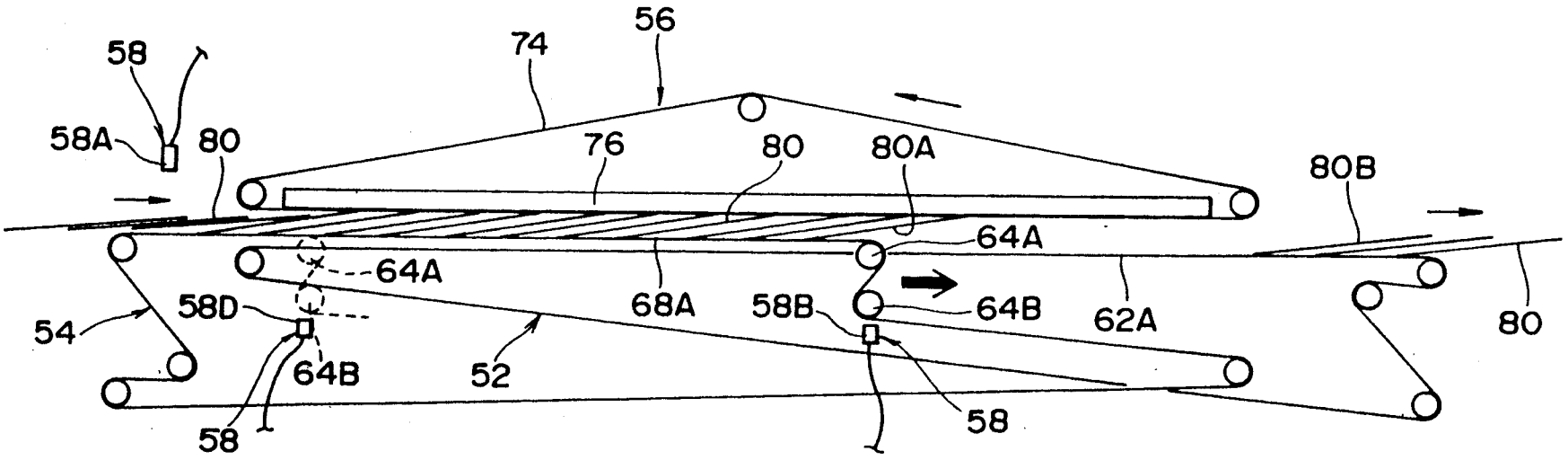
FIG. 5 is a front view of the present sheet conveying-/sorting system, illustrating a state in which the present system has separated the sheets.
Figure 6:
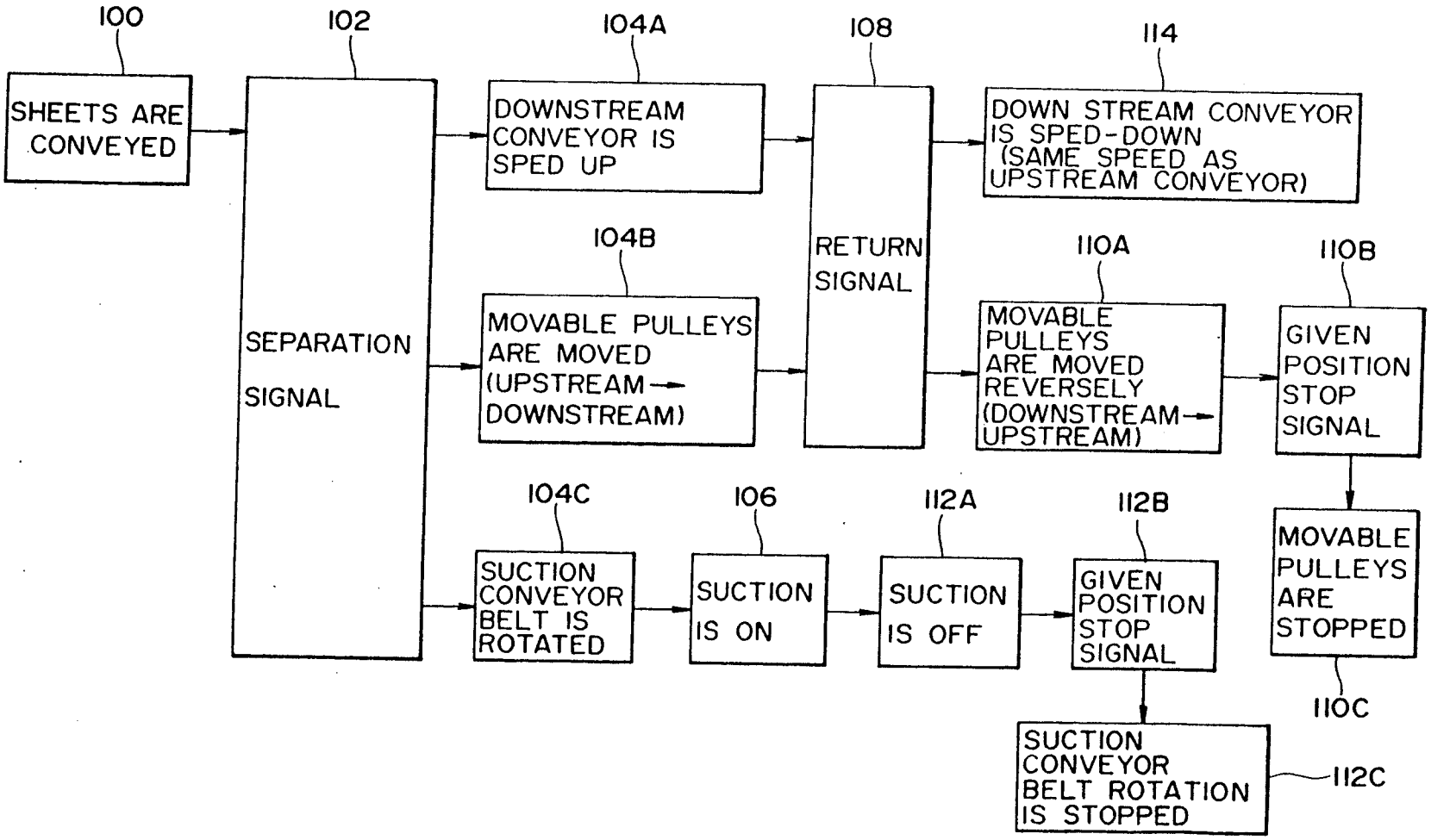
FIG. 6 is a flow chart to show the operation states of a sheet conveying/sorting system according to the invention; and, FIG. 7 is a perspective view of another embodiment of a sheet conveying/sorting system according to the invention.

Now, description will be given below of the operation of a sheet conveying/sorting system in the above-mentioned manner according to the invention with reference to FIG. 3 to FIG. 5 and flow charts in FIG. 6.

As shown in FIGS. 3(A) and (B), the sheets 80, 80, cut in the previous step are respectively overlapped on their adjoining sheets 80 and are then guided to the conveying passage 68A of the upstream conveying means 54. These sheets 80, 80, are then guided from the conveying passage 68A to the conveying passage 62A of the downstream conveying means 52, and are conveyed by the conveying passage 62A to a sheet collecting part (not shown) sequentially, so that the sheets 80, 80, . . . are collected in the sheet collecting part (Step 100).

In this case, the detector 58A of the control means 58 counts the number of sheets 80, 80, . . . conveyed and, when the number of sheets conveyed reaches a target number, the detector 58A outputs signal to the effect to the control means 58. On receiving the signal from the detector 58A, the control means 58 outputs a separation signal (Step 102). As shown in FIGS. 4 (A) and (B), the separation signal moves the movable pulleys 64A, 64B of the upstream conveying means 54 in a right direction along the conveying passage 62A of the downstream conveying means 52 at the same speed as the conveying speed of the upstream conveying means 54. For this reason, the conveying passage 68A of the upstream conveying means 54 is expanded in the right direction (Step 104B).

Also, due to the separation signal, the belt 74 of the sucking/conveying means 56 is started to rotate counter clockwise at the same speed as the speed of the upstream conveying means (Step 104C) and the holes 74A, 74A, . . . of the belt 74 are moved to the lower portion of the suction box 76, so that the leading end portions of the sheets 80, 80, . . . being conveyed in the conveying passage 68A of the upstream conveying means 54 are sucked to the belt 74. As a result of this, the sheet 80A in the conveying passage 6BA and the sheet 80B in the conveying passage 62A of the downstream conveying means 52 are separated from each other (Step 106).

Figure 4A:
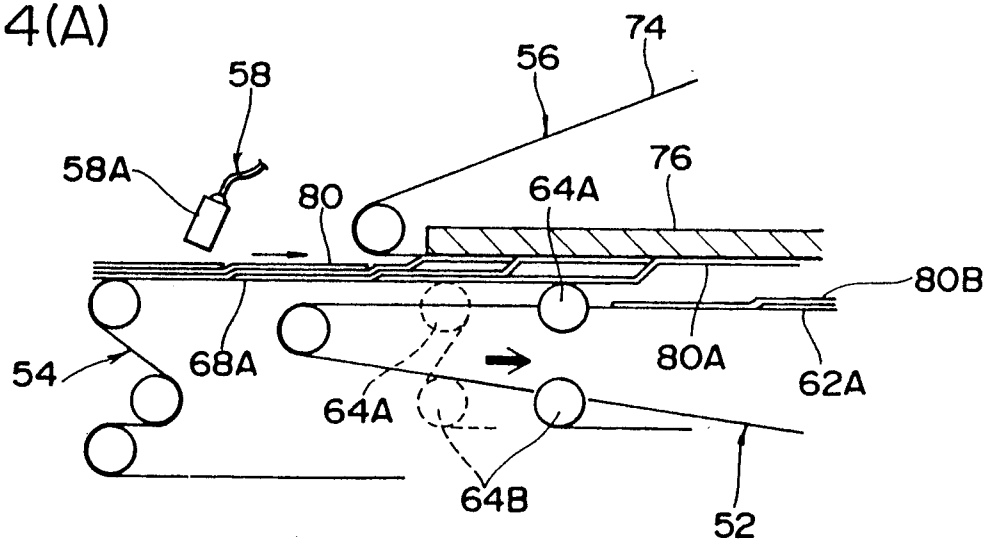
FIG. 4(A) is an enlarged view of the main portions of the present sheet conveying/sorting system, illustrating a state in which the present system starts the operation of separating the sheets.
Figure 4B:
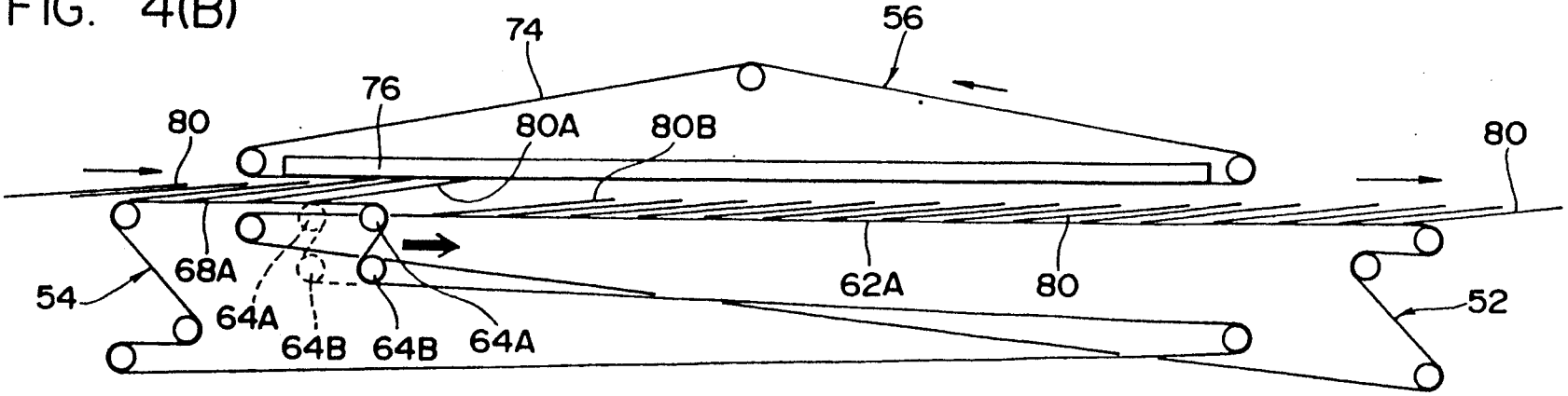
FIG. 4(B) is a front view of the main portions of the present sheet conveying/sorting system in the state shown in FIG. 4(A)

Further, the separation signal makes the conveying speed of the downstream conveying means 52 faster than the conveying speed of the upstream conveying means 54, so that the separated sheet 80A and sheet 80B are moved apart from each other, as shown in FIG. 4, (Step 104A).

After the sheets 80A and 80B separated from each other, the return detector 58B of the control means 58 outputs a return signal (Step 108). The return signal causes the movable pulleys 64A, 64B of the upstream conveying means 54 to move upstream and, after the movable pulleys 64A, 64B are detected by the given position detector 58D, the return signal causes the movable pulleys 64A, 64B to stop its movements, so that the movable pulleys 64A, 64B can be returned to their respective original positions. As a result of this, the length of the conveying passage 68A of the upstream conveying means 54 is contracted to its original length (Step 110A, 110B, 110C). At the same time, the holes 74A, 74A, . . . of the belt 74 of the sucking/conveying means 56 are moved from the lower portion of the suction box 76 up to the upper portion thereof and are stopped at their given positions in accordance with a signal from the given position detector 58C, so that the suction of the sheets 80, 80, . . . to the belt 74 is removed (Steps 112A, 112B, 112C). Further, the return signal returns the conveying speed of the downstream conveying means 52 to the speed equal to the conveying speed of the upstream conveying means 54 (Step 114). For this reason, the sheets 80, 80, . . . are successively conveyed from the upstream conveying means 54 to the downstream conveying means 52.

By executing the above-mentioned steps repeatedly. The sheets are sorted by the target numbers and thus the sheets can be stably sorted by the package units in a sheet collecting part in the following step.

As described above, in the above embodiment, there are provided the endless belts 74 in the sucking/conveying means 56 and the belts 74 are rotated to thereby separate the sheets 80, 80, . . . from each other. However, the invention is not limited to this, but alternatively, as in the second embodiment, the suction box may be moved to thereby separate the sheets 80, 80, . . . from each other.

Description will be given below of another embodiment of a sheet conveying/sorting system according to the invention with reference to FIGS. 7 to 11. In these figures, the same or similar parts as in the above mentioned embodiment are given the same designations and the description thereof is omitted here.

Figure 7:
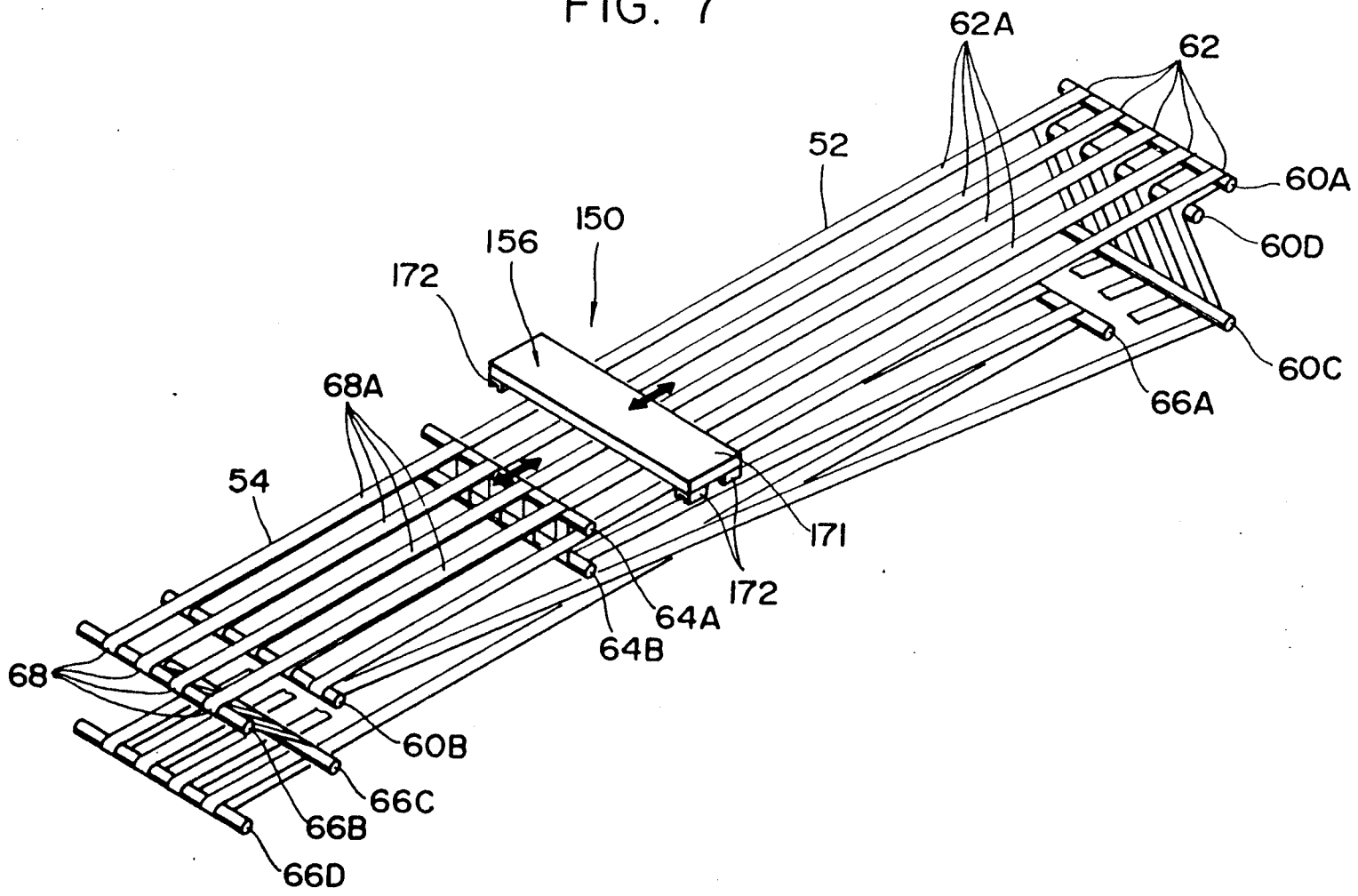

As shown in FIG. 7, a sheet conveying/sorting system 150 comprises downstream conveying means (separating conveyor means) 52, upstream conveying means (movable conveyor means) 54, sucking/conveying means (movable suction box means) 156, control means 58 (shown in FIG. 8, FIG. 10) and the like.

A suction box 171 of the sucking/conveying means 156 is disposed above the downstream conveying means 52 and upstream conveying means 54 and liner bearings 172, 172 are mounted to and supported by the two ends of the suction box 171. In this manner, the suction box 171 is structured such that is can be moved along a conveying passage 62A of the downstream conveying means 52 similarly to the upstream conveying means 54.

Also, there are formed a large number of holes (not shown) on the lower surface of the suction box 171, and the holes are adapted to communicate with a pump (not shown) so as to provide a suction port.

Figure 8A:
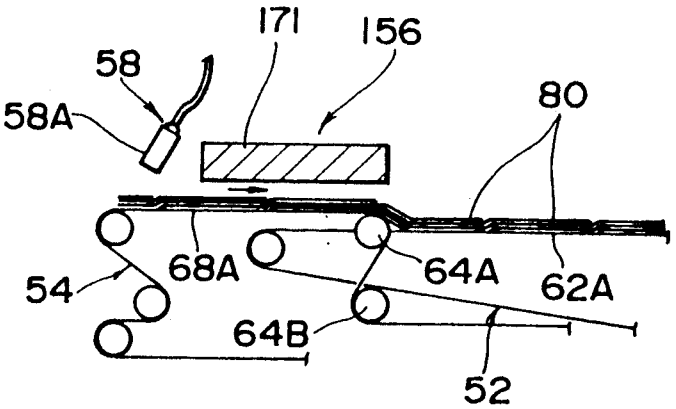
FIG. 8 (A) is an enlarged view of the main portions of a second embodiment of a sheet conveying/sorting system according to the invention, illustrating a state in which the embodiment is not performing its sheet separation operation.

The control means 58 includes a detector 58A which, as shown in FIG. 8(A), is disposed above the upstream conveying means 54 and on the upstream side of the sucking/conveying means 156. The detector 58A counts the number of sheets 80, 80, . . . conveyed and, when the number of sheets 80 conveyed reaches a target number, that is, a package unit number, outputs a separation signal. The separation signal output from the detector 58A is input through the control means 58 into the downstream conveying means 52, upstream conveying means 54 and sucking/conveying means 156.

The separation signal controls the second drive means of the upstream conveying means 54 to move the movable pulleys 64A, 64B in a conveying direction at the same speed as the speed of the subject conveying means. At the same time, the separation signal controls the third drive means of the sucking/conveying means 156 to suck in air through the numerous holes formed on the suction box 171 and also to move the suction box 171 in the conveying direction at the same speed as that of the upstream conveying means 54. Simultaneously, the separation signal controls the first conveying means of the downstream conveying means 52 to the make the conveying speed thereof faster than the conveying speed of the upstream conveying means 54.

Also, the control means 58 outputs a return signal after a return detector 58B (see FIG. 10) disposed downstream detects the movable pulleys 64A, 64B. The return signal returns the movable pulleys 64A, 64B of the upstream conveying means 54 and at the same time returns the increased conveying speed of the downstream conveying means 52 to the conveying speed of the upstream conveying means 54. At the same time, the return signal causes the suction box 171 of the sucking/conveying means 156 to stop its sucking operation and to return to its original position. In this case, a given position stop detector 58C, 58D (see FIG. 8) included in the control means 58 detects the movable pulleys 64A, 64B of the upstream conveying means 54 and the suction box 171 of the sucking/conveying means 156 and outputs a stop signal. The second and third drive means moving in the conveying direction are caused to stop in accordance with the stop signal.

Figure 8B:
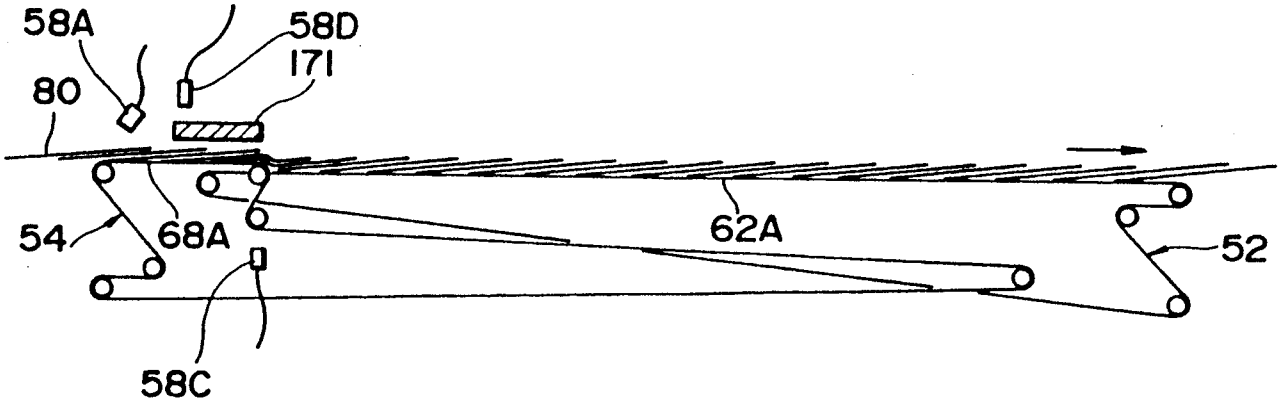
Figure 9A:
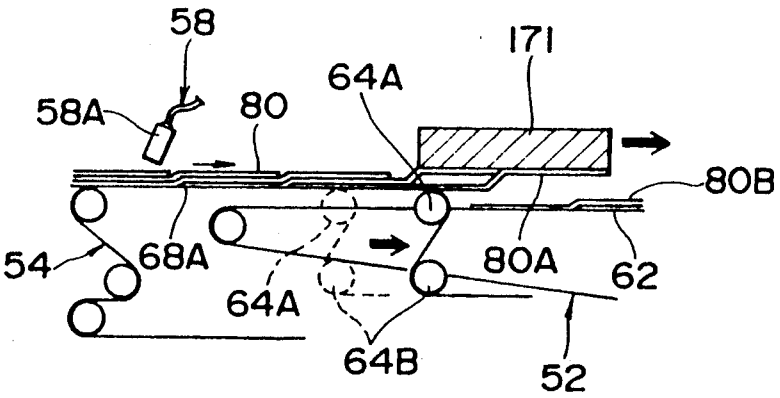
FIG. 9 (A) is an enlarged view of the main portions of the second embodiment according to the invention, illustrating a state in which the second embodiment starts its sheet separation operation.
Figure 10:
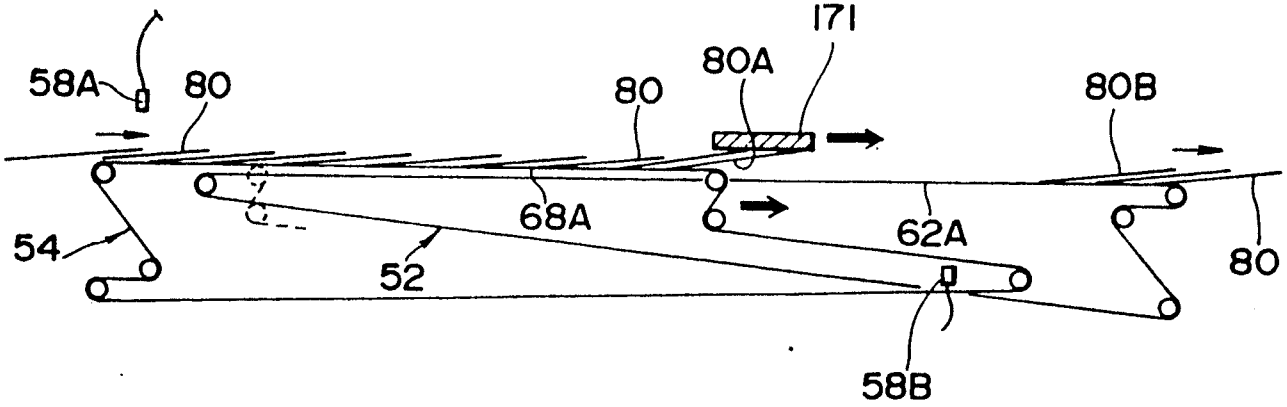
FIG. 10 is a front view of the second embodiment of a sheet conveying/sorting system according to the invention, illustrating a state in which the second embodiment has separated the sheets from each other; and, FIG. 11 is a flow chart of the operating states of the second embodiment according to the invention; and, FIG. 12 is a front view of a sheet conveying/sorting system according to the prior art.
Figure 11:
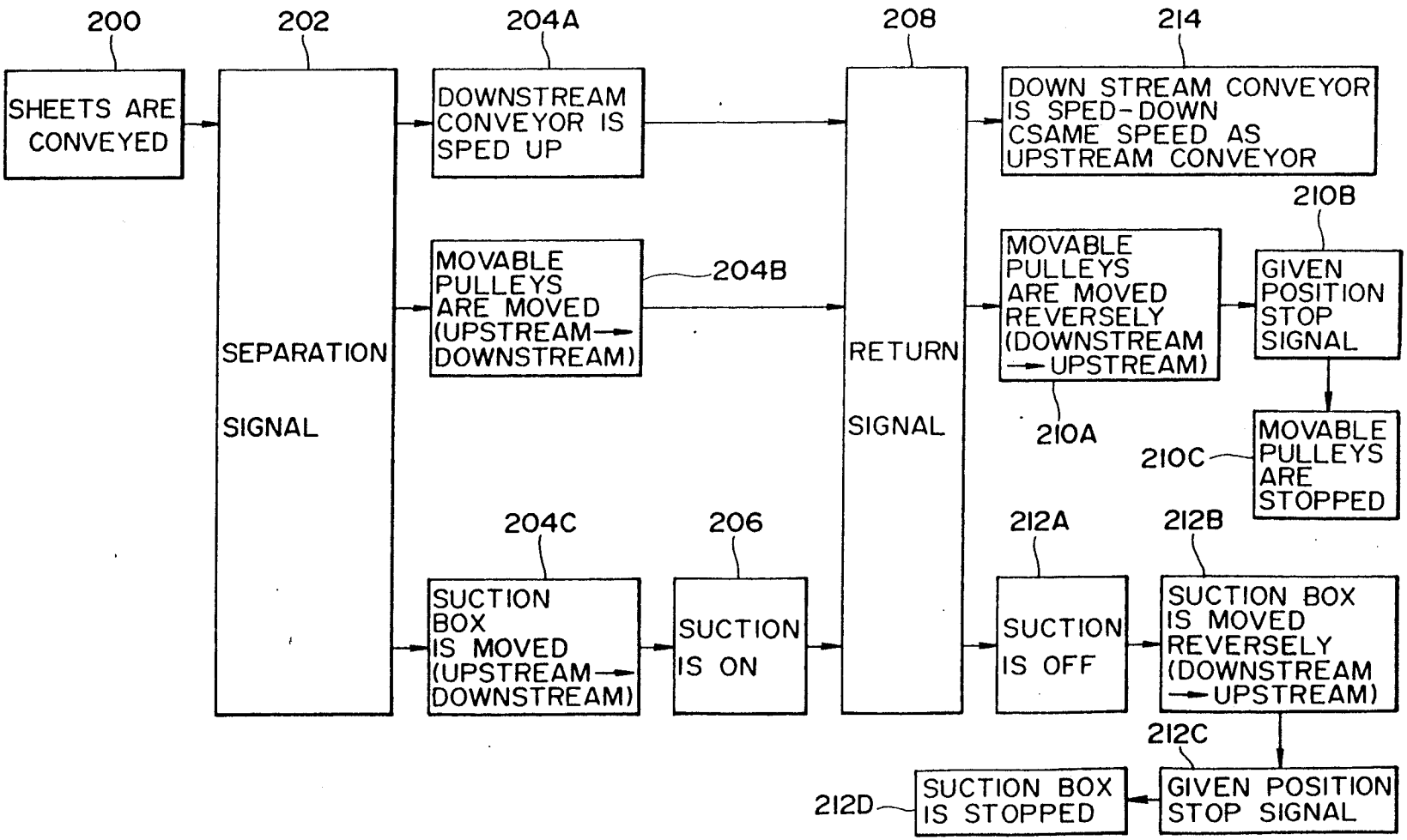
Figure 12:
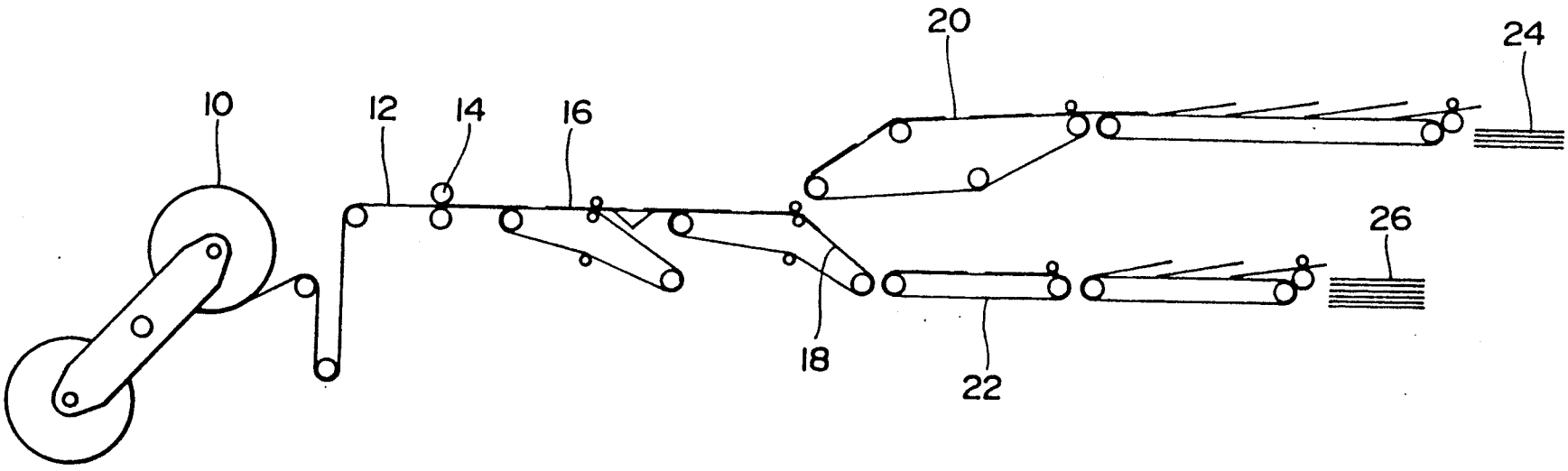

Now, description will be given below of the operation of another embodiment of a sheet conveying/sorting system in the above-mentioned manner according to the invention with reference to FIGS. 8 to 10 and flow charts shown in FIG. 11.

As shown in FIGS. 8(A) and (B), the sheets 80, 80, . . . cut in the previous step are respectively overlapped on their adjoining sheets 80 and are then guided to the conveying passage 68A of the upstream conveying means 54. These sheets 80, 80, . . . are then guided from the conveying passage 68A to the conveying passage 62A of the downstream conveying means 52, and are conveyed by the conveying passage 62A to a sheet collecting part (not shown) sequentially, so that the sheets 80, 80, . . . are collected in the sheet collecting part (Step 200).

In this case, the detector 58A of the control means 58 counts the number of sheets 80, 80, . . . conveyed and, when the number of sheets conveyed reaches a target number, the detector 58A outputs a signal to the effect to the control means 58. On receiving the signal from the detector 58A, the control means 58 outputs a separation signal (Step 202). As shown in FIGS. 9(A) and (B), the separation signal moves the movable pulleys 64A, 64B of the upstream conveying means 54 in a right direction along the conveying passage 62A of the downstream conveying means 52 at the same speed as the conveying speed of the upstream conveying means 54. For this reason, the conveying passage 68A of the upstream conveying means 54 is expanded in the right direction (Step 204B).

Also, due to the separation signal, the suction box 171 of the sucking/conveying means 156 is started to move in a right direction along the conveying Passage 62A of the downstream conveying means 52 at the same speed as that of the upstream conveyor (Step 204C), and at the same time the front end portions of the sheets 80, 80, being conveyed in the conveying passage 68A of the upstream conveying means 54 are sucked by the suction port in the lower surface of the suction box 171. As a result of this, the sheet 80A in the conveying passage 68A can be separated from the sheet 80B in the conveying passage 62A of the downstream conveying means 52 (Step 206).

Figure 9B:
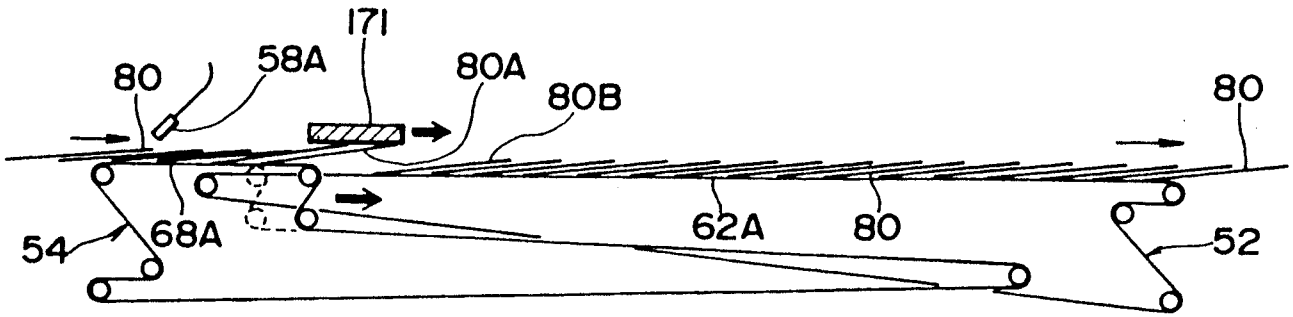

Further, the separation signal makes the conveying speed of the downstream conveying means 52 faster than the conveying speed of the upstream conveying means 54, so that the separated sheet 80A and 80B are moved apart from each other, as shown in FIG. 9, (Step 204A).

After the sheets 80A and 80B are separated from each other, the return detector 58B of the control means 58 outputs a return signal (Step 208). This return signal return the movable pulleys 64A, 64B of the upstream conveying means 54 to their respective original positions, so that the length of the conveying passage 68A of the upstream conveying means 54 is contracted and returned to its original length in accordance with a signal from the given position detector 58C (Steps 210A, 210B, 210C). At the same time, the suction of the suction box 171 of the sucking/conveying means 156 is removed, so that the suction box 171 is moved upwardly from the sucking position thereof and is stopped at its original position in accordance with a signal from the given position detector 58D (Step 212A, 212B, 212C, 212D). Further, the return signal causes the conveying speed of the downstream conveying means 52 to return to the same speed as the conveying speed of the upstream conveying means 54 (Step 214). As a result of this, the sheets 80, 80, . . . are conveyed successively from the upstream conveying means 54 to the downstream conveying means 52.

From now on, by repeating the above-mentioned steps sequentially, the sheets can be sorted by a target number of sheets and thus the sheets can be sorted by a package unit in a sheet collecting part in a following step.

However, the invention is not limited to the above, but other structures may be employed. For example, air may be blown separated the portion from the downstream side, or the downstream conveying means 52 may be constructed in the form of a suction conveyor in order to improve the separation between the sheets.

Alternatively, the detector 58B may be moved to the upstream side so that the speeds of the upstream conveying means 54 and sucking/conveying means 56, 156 can be increased after they return to their respective original positions. This structure is able to cope with a small package unit.

As has been described hereinbefore, according to the present invention, since there is eliminated the need for provision of a plurality of conveying passages to sort the sheets, the manufacturing costs can be reduced and the installation space of the whole system can also be minimized. Also, due to the fact that the sheet gating-out and cutting speeds need not be delayed, the theoretically expected rate of the sheets and a production efficiency are not be lowered. Further, because the sheets can be sorted without using any fork or stopper, it is possible to prevent the sheets from being disturbed in conveying as well as to prevent the sheets against abrasions.

It should be understood, however, that there is no intention to limit the invention to the specific forms disclosed, but on the contrary, the invention is to cover all modifications, alternate constructions and equivalents falling within the spirit and scope of the invention as expressed in the appended claims.

I claim:

1. A sheet conveying/sorting system for sorting a plurality of sheets being successively conveyed by given numbers, said system comprising:

downstream conveying means for conveying said sheets, the conveying speed of said downstream conveying means being variable;

upstream conveying means disposed upstream of said downstream conveying means and including a conveying passage in the downstream side of said upstream conveying means, said conveying passage being expandable and contractible along a conveying passage of said downstream conveying means;

sucking/conveying means disposed above said conveying passage of said upstream conveying means and said conveying passage of said downstream conveying means for sucking said sheets and conveying said sheets along said conveying passages; and, control means for counting the number of said sheets conveyed and outputting a separation signal when said number of said sheets conveyed reaches a given number, said separation signal allowing said sucking/conveying means to perform its sucking operation, said separation signal making the conveying speed of said downstream conveying means faster than the conveying speed of said upstream conveying means to thereby separate said sheets from their following sheets, and at the same time said separation signal expanding said conveying passage of said upstream conveying means to thereby convey said following sheets together with said sucking/conveying means, and said control means, after said upstream conveying means is detected by a return detector disposed downstream thereof, for outputting a return signal, said return signal contracting said expanded upstream conveying means to return to its original length before it is expanded, said return signal causing said sucking-/conveying means to stop its sucking operation and return to its original position, and at the same time said return signal returning the conveying speed of said downstream conveying means to a speed equal to the conveying speed of said upstream conveying means.

2. A sheet conveying/sorting system as set forth in claim 1, wherein said sucking/conveying means includes an endless belt stretched rotatably in an substantially triangular shape and a suction box disposed in contact with the upper surface of a bottom side portion of said substantially triangular endless belt, and wherein said endless belt includes a plurality of holes spaced at regular intervals in the portion thereof extending over almost half of its peripheral length, and said suction box includes suction ports in the surface thereof in contact with said endless belt, said holes in said endless belt being able to provide suction ports when they are situated at said suction ports of said suction box.

3. A sheet conveying/sorting system as set forth in claim 2, wherein said endless belt includes a positioning hole and, when said suction holes formed in said endless belt are disengaged from contact with said suction box, said positioning hole is detected by a given position stop detector to thereby stop the rotation of said endless belt.

4. A sheet conveying/sorting system as set forth in claim 1, wherein said conveying passage of said upstream conveying means is formed by stretching said endless belt by use of a plurality of pulleys, and said conveying passage of said upstream conveying means can be expanded and contracted by moving said pulleys.

5. A sheet conveying/sorting system as set forth in claim 1, wherein said sucking/conveying means includes a suction box disposed to be freely movable along said conveying passage of said downstream conveying means and said conveying passage of said upstream conveying means, and said suction box includes a suction port formed in the surface thereof opposing to said conveying passages of said downstream and upstream conveying means.

* * * * *